US005919612A

United States Patent [19]

Ly et al.

[11] Patent Number: 5,919,612

[45] Date of Patent: Jul. 6, 1999

[54] COLOR PHOTOGRAPHIC SILVER HALIDE MATERIAL

[75] Inventors: Cuong Ly, Köln; Wolfgang Schmidt; Bruno Mücke, both of Bergisch Gladbach; Michael Missfeldt, Leichlingen, all of Germany

[73] Assignee: Agfa-Gevaert AG, Germany

[21] Appl. No.: 08/785,691

[22] Filed: Jan. 17, 1997

[30] Foreign Application Priority Data

Jan. 26, 1996 [DE] Germany ..... 196 02 749
Aug. 26, 1996 [DE] Germany ..... 196 34 385

[51] Int. Cl.[6] ..... G03C 1/20

[52] U.S. Cl. ..... 430/583; 430/584; 430/611; 430/613

[58] Field of Search ..... 430/583, 584, 430/611, 613

[56] References Cited

U.S. PATENT DOCUMENTS 3,305,362 2/1967 O'Riester et al. .
5,252,454 10/1993 Suzumoto et al. ..... 430/576
5,385,813 1/1995 Klotzer et al. ..... 430/503

FOREIGN PATENT DOCUMENTS 1447577 3/1964 Germany .
1472850 8/1965 Germany .

*Primary Examiner*—Thorl Chea
*Attorney, Agent, or Firm*—Connolly & Hutz

[57] ABSTRACT

A color photographic silver halide material having a support and at least one silver halide emulsion layer, which contains a sensitiser of the formula (I), a stabiliser of the formula (II) and a stabiliser of the formula (III)

(I)

(II)

(III)

in which $R_1$ to $R_{14}$, $X_1$, $X_2$, $X^{\ominus}$, $L_1$ to $L_5$ and n have the meaning stated in the description, is distinguished by improved storage stability.

6 Claims, No Drawings

COLOR PHOTOGRAPHIC SILVER HALIDE MATERIAL

This invention relates to a colour photographic silver halide material having elevated sensitivity and good storage stability.

In particular, the invention relates to a colour photographic paper which, when stored within the temperature range from 20 to 50° C., exhibits no sensitometric change and thus need not be stored at a low temperature in the period between production and processing.

Colour photographic paper is produced in few production plants, is dispatched all over the world from these plants and finally converted by exposure and processing into colour photographic prints. Between production and processing, the material is stored for various periods under the most varied conditions. The low temperature storage and transport conditions specified by the manufacturer not only entail elevated costs, but are also frequently not fulfilled. This reduces the quality of the colour prints and results in complaints.

There is thus a requirement to produce colour photographic materials, in particular colour photographic paper, which do not require low temperature storage and which, even when stored for relatively extended periods at 20 to 50° C., do not exhibit any sensitometric changes, particularly in the red sensitive layers.

It has now surprisingly been found that this object is achieved with a combination of a certain red sensitiser and at least two specific stabilisers.

The present invention accordingly provides a colour photographic silver halide material having a support and at least one silver halide emulsion layer, characterised in that the silver halide emulsion contains a sensitiser of the formula (I), a stabiliser of the formula (II) and a stabiliser of the formula (III):

(I)

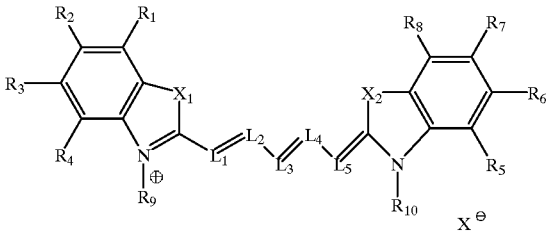

in which $R_1$ to $R_8$ mean H, $CH_3$, Cl, F or $OCH_3$ or $R_2$ and $R_3$ or $R_3$ and $R_4$ or $R_6$ and $R_7$ or $R_7$ and $R_8$ mean the remaining members of a carbocyclic ring system, $X_1$ and $X_2$ mean O, S, Se or N—$R_{11}$, $R_9$ and $R_{10}$ mean optionally substituted alkyl or $R_9$ together with $L_1$ or $R_{10}$ together with $L_5$ mean the remaining members of a 5-to 7-membered saturated or unsaturated ring, $L_1$ to $L_5$ mean optionally substituted methine groups or $L_2$, $L_3$ and $L_4$ together mean the members of a 5- to 7-membered ring;

$R_{11}$ means $C_1$–$C_4$ alkyl and

X⊖ means an anion necessary for charge equalisation;

(II)

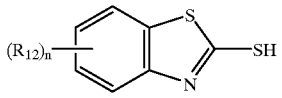

in which $R_{12}$ means a substituent and n means a number 1, 2 or 3;

(III)

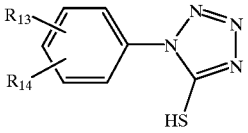

in which $R_{13}$ means H, $CH_3$ or $OCH_3$, $R_{14}$ means H, OH, $CH_3$, $OCH_3$, NHCO—$R_{15}$, $COOR_{15}$, $SO_2NH_2$ or $NHCONH_2$ and $R_{15}$ means $C_1$,–$C_4$ alkyl.

Suitable compounds of the formula (I) are:

I-1

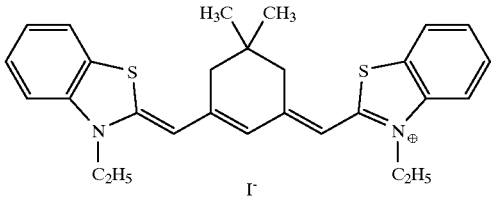

-continued
I-2
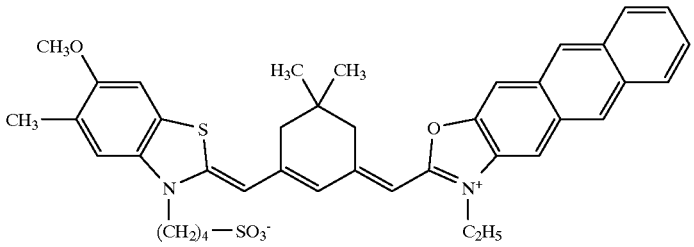
I-3
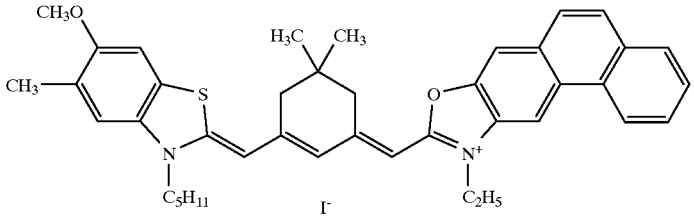
I-4
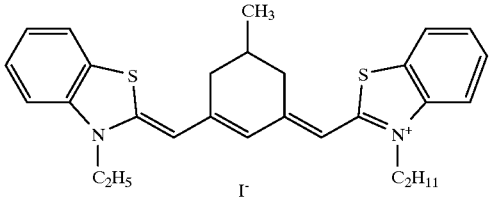
I-5
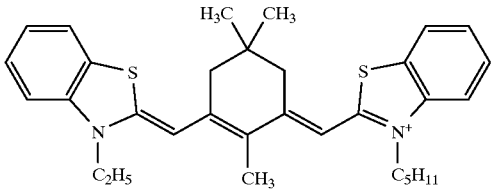
I-6
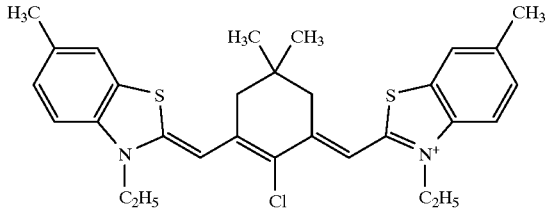
I-7
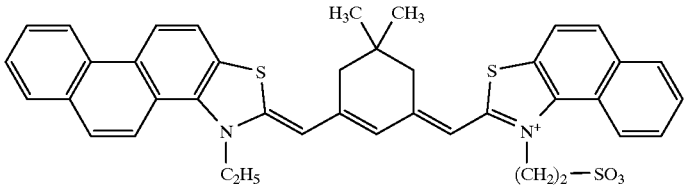

-continued
I-8
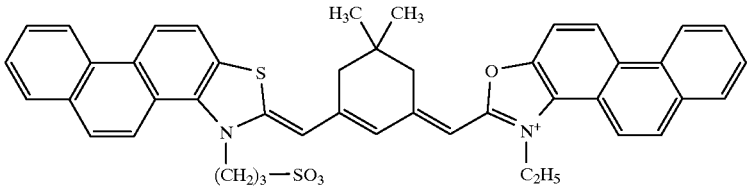
I-9
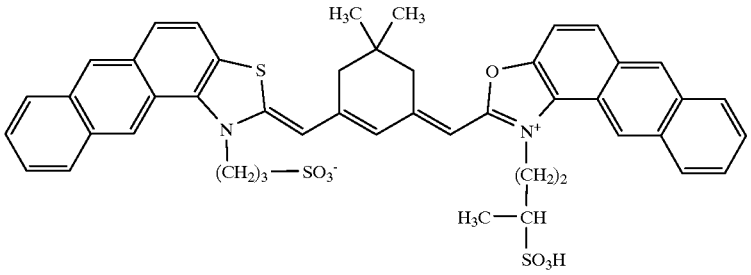
I-10
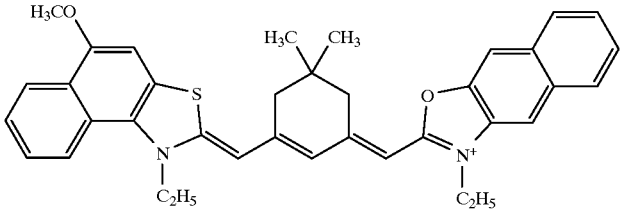
I-11
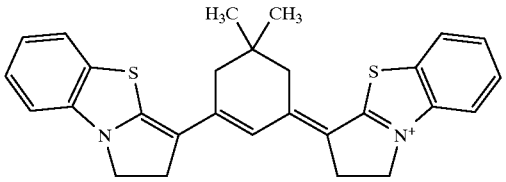
I-12
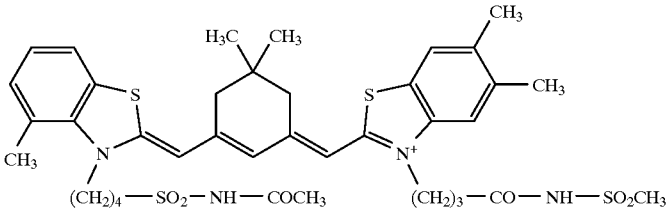
I-13
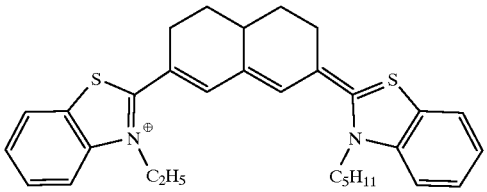

Suitable stabilisers of the formula (II) are in particular those in which R12 has the meaning

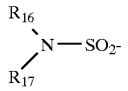

and $R_{16}$ and $R_{17}$ mutually independently mean H, Cl, $C_1$–$C_4$ alkyl, phenyl or chlorophenyl.

The compound of the formula

II-1

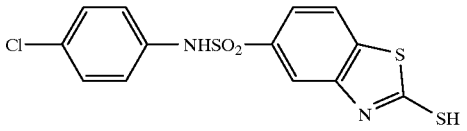

is particularly preferred.

The following are suitable compounds of the formula (III):

| | $R_{13}$ | $R_{14}$ |
|---|---|---|
| III-1 | H | H |
| III-2 | H | o-$OCH_3$ |
| III-3 | H | m-$OCH_3$ |
| III-4 | H | p-$OCH_3$ |
| III-5 | H | o-OH |
| III-6 | H | m-OH |
| III-7 | H | p-OH |
| III-8 | H | m-$NHCOCH_3$ |
| III-9 | H | p-$COOC_2H_5$ |
| III-10 | H | p-COOH |
| III-11 | H | m-$NHCONH_2$ |
| III-12 | H | p-$SO_2NH_2$ |
| III-13 | o-$OCH_3$ | p-$OCH_3$ |

The compounds of the formulae (I), (II) and (III) are preferably used in the following quantities per kg of $AgNO_3$ of the emulsion concerned:

(I): 50 to 500 mg; in particular 100 to 250 mg (II): 1000 to 5000 mg; in particular 1000 to 3000 mg (III): 50 to 2000 mg; in particular 50 to 1000 mg.

The compounds of the formulae (I) to (III) are in particular added after chemical ripening, compound (III) optionally also during chemical ripening. The combination according to the invention of sensitiser and stabilisers is particularly effective in silver halide emulsions which consist of at least 95 mol. % of AgCl and, in particular, contain no iodide. The remainder to 100 mol. % is preferably AgBr. The grain size of the emulsions is preferably 0.2 to 1.0 $\mu$m, in particular 0.3 to 0.6 $\mu$m. The silver halide grains are preferably cubic; in particular they have a narrow (monodisperse) grain size distribution.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in Research Disclosure 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling, silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers to prevent blue light from reaching the underlying layers.

Possible options for different layer arrangements and the effects thereof on photographic properties are described in J. Inf. Rec. Mats., 1994, volume 22, pages 183–193.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 25 30 645).

The substantial constituents of the photographic emulsion layers are binder, silver halide grains and colour couplers.

Details of suitable binders may be found in Research Disclosure 37254, part 2 (1995), page 286.

Details of suitable silver halide emulsions, the production, ripening, stabilisation and spectral sensitisation thereof, including suitable spectral sensitisers, may be found in Research Disclosure 37254, part 3 (1995), page 286 and in Research Disclosure 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 mol. % of AgBr or silver chloride-bromide emulsions with above 95 mol. % of AgCl.

Details relating to colour couplers may be found in Research Disclosure 37254, part 4 (1995), page 288 and in Research Disclosure 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290 and in Research Disclosure 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally located between layers of different spectral sensitivity may contain agents which prevent an undesirable diffusion of developer oxidation products from one photosensitive layer into another photo-sensitive layer with a different spectral sensitisation.

Suitable compounds (white couplers, scavengers or DOP scavengers) may be found in Research Disclosure 37254, part 7 (1995), page 292 and in Research Disclosure 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in Research Disclosure 37254, part 8 (1995), page 292 and in Research Disclosure 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294 and in Research Disclosure 37038, part XII (1995), page 86.

Once exposed with an image, colour photographic materials are processed using different processes depending upon their nature. Details relating to processing methods and the necessary chemicals are disclosed in Research Disclosure 37254, part 10 (1995), page 294 and in Research Disclosure 37038, parts XVI to XXIII (1995), pages 95 et seq. together with example materials.

EXAMPLES

Emulsion A

The following solutions are each prepared with demineralised water:

| | | | |
|---|---|---|---|
| Solution 1 | 4000 | g | water |
| | 500 | g | gelatine |
| Solution 2 | 6700 | g | water |
| | 1300 | g | NaCl |
| | 0.4 | mg | $K_2IrCl_6$ |
| | 0.2 | mg | $Na_3RhCl_6$ |
| Solution 3 | 6500 | g | water |
| | 3600 | g | $AgNO_3$ |

Solutions 2 and 3 are simultaneously stirred vigorously into solution I at 45° C. over the course of 70 minutes at a pAg of 7.7. A silver chloride emulsion having an average particle diameter of 0.5 $\mu$m is obtained. The gelatine/$AgNO_3$ weight ratio is 0.14. In a known manner, the emulsion is ultrafiltered, washed and redispersed in a quantity of gelatine such that the gelatine/$AgNO_3$ weight ratio is 0.56. The emulsion contains 1.5 mol of silver halide per kg. The emulsion is divided into four equal portions (each portion containing 900 g of $AgNO_3$) and chemically ripened and sensitised in the following manner:

Ripening (A-1):

The emulsion is ripened at a pH of 5.3 with 18 $\mu$mol of gold(III) chloride/mol of Ag and 7 $\mu$mol of $Na_2S_2O_3$/mol of Ag at a temperature of 70° C. for 3 hours. After chemical ripening, the emulsion is spectrally sensitised at 50° C. with 200 mg of compound (I-7)/kg of Ag and stabilised with 2 g of compound (II-1)/kg of Ag.

Ripening (A-2):

Chemical ripening is performed as in emulsion (A-1). However, 5 minutes after addition of the $Na_2S_2O_3$, 50 mg of compound (III-4) are added. Sensitisation and stabilisation are then performed as in (A-1).

Ripening (A-3):

As per (A-2), but with 200 mg of compound (III-4).

Photographic testing of the emulsions

A photographic recording material having the following layers is produced on a polyethylene-coated paper support:

| | |
|---|---|
| 1st layer (red-sensitive, cyan-coupling) | |
| Emulsion A-1, corresponding to | 0.30 g/m$^2$ $AgNO_3$ |
| Cyan coupler C-1 | 0.42 g/m$^2$ |
| Tricresyl phosphate | 0.42 g/m$^2$ |
| 2nd layer (protective layer) | |
| Gelatine | 1.60 g/m$^2$ |
| 3rd layer (hardening layer) | |
| Hardener H-1 | 0.20 g/m$^2$ |

The material is exposed through a step wedge for 40 ms and processed using process AP 94.

C-1

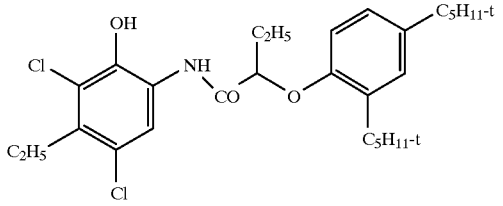

H-1

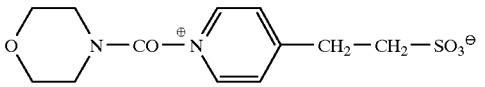

The sensitometric results obtained are shown in Tables 1 to 3.

TABLE 1

| Ripening | | Compound (III-4) mg/kg Ag | Compound (I-7) mg/kg Ag | Compound (II-1) mg/kg Ag | $D_{min}$ | logI.t | γ1 | γ2 |
|---|---|---|---|---|---|---|---|---|
| (A-1) | Comparison | 0 | 200 | 2000 | 0.88 | 1.417 | 2.31 | 4.67 |
| (A-2) | Invention | 50 | 200 | 2000 | 0.86 | 1.470 | 2.36 | 4.67 |
| (A-3) | Invention | 200 | 200 | 2000 | 0.85 | 1.490 | 2.31 | 4.50 |

$D_{min}$ fog after 1 day
logI.t sensitivity after 1 day
γ1 threshold gradation after 1 day
γ2 shoulder gradation after 1 day

TABLE 2

| Ripening | | Compound (III-4) mg/kg Ag | Compound (I-7) mg/kg Ag | Compound (II-1) mg/kg Ag | ΔDm in | ΔlogI.t | Δγ1 | Δγ2 |
|---|---|---|---|---|---|---|---|---|
| (A-1) | Comparison | 0 | 200 | 2000 | 0.03 | 0.047 | −0.25 | −0.35 |
| (A-2) | Invention | 50 | 200 | 2000 | 0.03 | 0.020 | −0.15 | −0.21 |
| (A-3) | Invention | 200 | 200 | 2000 | 0.03 | −0.008 | −0.08 | −0.15 |

$\Delta D_{min}$ fog after 4 weeks' storage at 37° C. minus fog after 1 day
ΔlogI.t sensitivity after 4 weeks' storage at 37° C. minus sensitivity after 1 day
Δγ1 threshold gradation after 4 weeks' storage at 37° C. minus threshold gradation after 1 day
Δγ2 shoulder gradation after 4 weeks' storage at 37° C. minus shoulder gradation after 1 day

TABLE 3

| Ripening | | Compound (III-4) mg/kg Ag | Compound (I-7) mg/kg Ag | Compound (II-1) mg/kg Ag | $\Delta D_{min}$ | ΔlogI.t | Δγ1 | Δγ2 |
|---|---|---|---|---|---|---|---|---|
| (A-1) | Comparison | 0 | 200 | 2000 | 0.07 | 0.024 | −0.08 | −0.15 |
| (A-2) | Invention | 50 | 200 | 2000 | 0.06 | 0.011 | −0.05 | −0.10 |
| (A-3) | Invention | 200 | 200 | 2000 | 0.04 | −0.005 | −0.03 | −0.04 |

$\Delta D_{min}$ fog after 6 months' storage at 23° C. minus fog after 1 day
ΔlogI.t sensitivity after 6 months' storage at 23° C. minus sensitivity after 1 day
Δγ1 threshold gradation after 6 months' storage at 23° C. minus threshold gradation after 1 day
Δγ2 shoulder gradation after 6 months' storage at 23° C. minus shoulder gradation after 1 day Emulsion B Emulsion B is produced and processed in the same manner as emulsion A, but with the difference that no $Na_3RhCl_6$ is added to solution 2. After redispersion, the emulsion contains 1.5 mol of silver halide per kg. The emulsion is ripened at a pH of 5.3 with 9 μmol of gold(III) chloride/mol of Ag and 7 μmol of $Na_2S,O_3$/mol of Ag at a temperature of 70° C. for 3 hours. After chemical ripening, the emulsion is divided to 8 equal portions (each portion containing 450 a of $AgNO_3$) and spectrally sensitised as follows:

Ripening (B-1):

Emulsion B is spectrally sensitised at 50° C. with 150 mg of compound (I-1)/kg of Ag and stabilised with 2 g of compound (II-1)/kg of Ag.

Ripening (B-2):

Sensitisation and stabilisation proceed as in ripening (B-1), but 400 mg of compound (III-8)/kg of Ag are additionally added 10 minutes after the addition of compound (II-1).

Ripening (B-3) to Ripening (B-7):

The amount of compound (II-1) and compound (III-8) respectively was varied according to Tables 4 to 6.

Photographic testing was performed in a similar manner as for emulsions A-1 to A-3.

The sensitometric results obtained are shown in Tables 4 to 6.

TABLE 4

| Ripening | | Compound (I-1) mg/kg Ag | Compound (II-1) mg/kg Ag | Compound (III-8) mg/kg Ag | $D_{min}$ | logI.t | γ1 | γ2 |
|---|---|---|---|---|---|---|---|---|
| (B-1) | Comparison | 150 | 2000 | 0 | 0.90 | 1.750 | 1.78 | 3.82 |
| (B-2) | Invention | 150 | 2000 | 400 | 0.89 | 1.621 | 1.70 | 3.62 |
| (B-3) | Invention | 150 | 1500 | 400 | 0.91 | 1.730 | 1.75 | 3.75 |
| (B-4) | Invention | 150 | 1500 | 800 | 0.88 | 1.563 | 1.65 | 3.45 |
| (B-5) | Invention | 150 | 1000 | 800 | 0.90 | 1.726 | 1.76 | 3.80 |

TABLE 4-continued

| Ripening | | Compound (I-1) mg/kg Ag | Compound (II-1) mg/kg Ag | Compound (III-8) mg/kg Ag | $D_{min}$ | logI.t | γ1 | γ2 |
|---|---|---|---|---|---|---|---|---|
| (B-6) | Comparison | 150 | 500 | 1200 | 0.88 | 1.304 | 1.56 | 2.94 |
| (B-7) | Comparison | 150 | 0 | 1200 | 0.93 | 1.580 | 1.70 | 3.51 |

$D_{min}$ fog after 1 day
logI.t sensitivity after 1 day
γ1 threshold gradation after 1 day
γ2 shoulder gradation after 1 day

TABLE 5

| Ripening | | Compound (I-1) mg/kg Ag | Compound (II-1) mg/kg Ag | Compound (III-8) mg/kg Ag | $\Delta D_{min}$ | ΔlogI.t | Δγ1 | Δγ2 |
|---|---|---|---|---|---|---|---|---|
| (B-1) | Comparison | 150 | 2000 | 0 | 0.04 | 0.050 | −0.15 | −0.22 |
| (B-2) | Invention | 150 | 2000 | 400 | 0.02 | 0.044 | −0.07 | −0.13 |
| (B-3) | Invention | 150 | 1500 | 400 | 0.03 | 0.048 | −0.09 | −0.17 |
| (B-4) | Invention | 150 | 1500 | 800 | 0.02 | 0.039 | −0.05 | −0.09 |
| (B-5) | Invention | 150 | 1000 | 800 | 0.04 | 0.052 | −0.06 | −0.10 |
| (B-6) | Comparison | 150 | 500 | 1200 | −0.03 | 0.040 | −0.03 | −0.08 |
| (B-7) | Comparison | 150 | 0 | 1200 | 0.07 | 0.076 | −0.06 | −0.11 |

$\Delta D_{min}$ fog after 4 weeks' storage at 37° C. minus fog after 1 day
ΔlogI.t sensitivity after 4 weeks' storage at 37° C. minus sensitivity after 1 day
Δγ1 threshold gradation after 4 weeks' storage at 37° C. minus threshold gradation after 1 day
Δγ2 shoulder gradation after 4 weeks' storage at 37° C. minus shoulder gradation after 1 day

TABLE 6

| Ripening | | Compound (I-1) mg/kg Ag | Compound (II-1) mg/kg Ag | Compound (III-8) mg/kg Ag | $\Delta D_{min}$ | ΔlogI.t | Δγ1 | Δγ2 |
|---|---|---|---|---|---|---|---|---|
| (B-1) | Comparison | 150 | 2000 | 0 | 0.05 | 0.031 | −0.10 | −0.32 |
| (B-2) | Invention | 150 | 2000 | 400 | 0.03 | 0.025 | −0.04 | −0.09 |
| (B-3) | Invention | 150 | 1500 | 400 | 0.04 | 0.027 | −0.05 | −0.11 |
| (B-4) | Invention | 150 | 1500 | 800 | 0.03 | 0.027 | −0.01 | −0.04 |
| (B-5) | Invention | 150 | 1000 | 800 | 0.04 | 0.035 | 0.01 | −0.08 |
| (B-6) | Comparison | 150 | 500 | 1200 | 0.04 | 0.039 | 0.10 | 0.14 |
| (B-7) | Comparison | 150 | 0 | 1200 | 0.08 | 0.060 | −0.05 | −0.10 |

$\Delta D_{min}$ fog after 6 months' storage at 23° C. minus fog after 1 day
ΔlogI.t sensitivity after 6 months' storage at 23° C. minus sensitivity after 1 day
Δγ1 threshold gradation after 6 months' storage at 23° C. minus threshold gradation after 1 day
Δγ2 shoulder gradation after 6 months' storage at 23° C. minus shoulder gradation after 1 day

We claim:

1. A color photographic silver halide material which comprises a support and at least one silver halide emulsion layer, wherein the silver halide emulsion contains a sensitizer of the formula (I), a stabilizer of the formula (II) in a quantity of 1,000 to 5000 mg/kg of Ag and a stabilizer of the formula (III) in a quantity of 50 to 2,000 mg/kg of Ag:

(I)

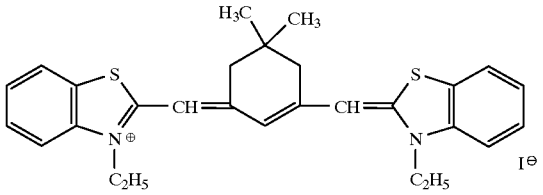

-continued (II)

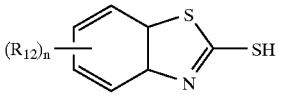

in which $R_{12}$ is a substituent and n is a number 1, 2 or 3;

(III)

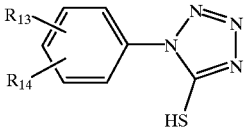

in which $R_{13}$ is H, $CH_3$ or $OCH_3$, $R_{14}$ is H, OH, $CH_3$, $OCH_3$, NHCO—$R_{15}$, $COOR_{15}$, $SO_2NH_2$ or $NHCONH_2$ and $R_{15}$ is $C_1$–$C_4$ alkyl.

2. The color photographic silver halide material according to claim 1, wherein the silver halide of the silver halide emulsion consists of at least 95 mol- % of AgCl.

3. The color photographic silver halide material according to claim 1, wherein the sensitizer of the formula I is used in an amount of 50 to 500 mg/kg of silver of the silver halide emulsion.

4. The color photographic silver halide material according to claim 1, wherein:

the sensitizer of the formula I is used in an amount from 100 to 250 mg per kg of silver of the silver emulsion; the compound of the formula II is used in an amount from 1,000 to 3,000 mg per kg of silver of the silver emulsion; and the compound of the formula III is used in an amount from 50 to 1,000 mg per kg of silver of the silver emulsion.

5. The color photographic silver halide material according to claim 1, wherein $R_{12}$ is

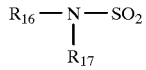

wherein $R_{16}$ and $R_{17}$ mutually independently are H, Cl, $C_1$–$C_4$ alkyl, phenyl or chlorophenyl.

6. The color photographic silver halide material according to claim 1, wherein the compound of formula (II) is

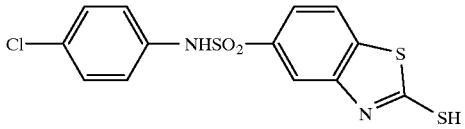

* * * * *